US005435527A

United States Patent [19]

Margaria

[11] Patent Number: 5,435,527

[45] Date of Patent: Jul. 25, 1995

[54] APPARATUS FOR THE LATE INTRODUCTION OF PARTICULATE ALLOY WHEN CASTING A LIQUID METAL

[75] Inventor: Thomas Margaria, Chedde, France

[73] Assignee: Pechiney Electrometallurgie, Courbevoie, France

[21] Appl. No.: 305,747

[22] PCT Filed: Oct. 16, 1991

[86] PCT No.: PCT/FR91/00808

§ 371 Date: Jun. 16, 1993

§ 102(e) Date: Jun. 16, 1993

[87] PCT Pub. No.: WO93/08309

PCT Pub. Date: Apr. 29, 1993

Related U.S. Application Data

[62] Division of Ser. No. 75,485, Jun. 16, 1993, abandoned.

[51] Int. Cl.[6] ..... B22D 41/00

[52] U.S. Cl. ..... 266/216; 266/233

[58] Field of Search ..... 266/216, 217, 233, 236; 222/603

[56] References Cited

U.S. PATENT DOCUMENTS

| | | | |
|---|---|---|---|
| 4,053,146 | 10/1977 | Smartt et al. | 266/216 |
| 4,997,167 | 3/1991 | Harma | 266/216 |
| 5,129,629 | 7/1992 | Christensen | 266/216 |

FOREIGN PATENT DOCUMENTS

| | | |
|---|---|---|
| 0639410 | 2/1964 | Belgium . |
| 0030220 | 6/1981 | European Pat. Off. . |

OTHER PUBLICATIONS

Japanese Patent Abstract No. 55-75856, Appl. No. 53-148540 Patent Abstracts of Japan, vol. 4, No. 116, Aug. 19, 1980.

Japanese Patent Abstract No. 55-75855, Appl. No. 53-148539 Patent Abstracts of Japan, vol. 4, No. 116, Aug. 19, 1980.

*Primary Examiner*—Scott Kastler

*Attorney, Agent, or Firm*—Dennison, Meserole, Pollack & Scheiner

[57] ABSTRACT

Apparatus for the late introduction of a particulate alloy when casting liquid metal, disposed between a casting ladle or an apparatus for the automatic feed of said metal and a series of moulds to be filled, characterised in that it comprises a jet of liquid metal of sufficient thickness, which is confined and in motion in a mixing chamber, for example a vortex, and a non-immersed introduction means (8) for the introduction of particles of alloy, imparting to said particles a speed and an energy sufficient for them to penetrate deeply into the interior of the liquid metal in the zone (4) of sufficient thickness, said zone being disposed in the vicinity of a casting orifice (5).

5 Claims, 3 Drawing Sheets

APPARATUS FOR THE LATE INTRODUCTION OF PARTICULATE ALLOY WHEN CASTING A LIQUID METAL

This is a divisional of application Ser. No. 08/075,485 filed on Jun. 16, 1993 now abandoned.

FIELD OF THE INVENTION

The invention concerns an apparatus and a process for the late introduction of particulate alloy (powder or gain) when casting a liquid metal (in general cast iron).

DESCRIPTION OF RELATED ART

The invention is intended in particular for the discontinuous casting of shaped parts in series of medium and great length in moulds obtained by automatic machines.

It is known that it is advantageous to effect the late introduction of agents for the treatment of cast iron (nodulising and/or inoculating agents) to obtain a quality which is as reproducible as possible of cast parts of cast iron and a good yield on the part of the treatment agents used, in particular when the agent contains magnesium which is volatile and difficult to dissolve in the liquid cast iron.

The late introduction operation can be carried out in a casting ladle just prior to the casting operation, but that results in an inadequate yield and insufficient regularity in terms of quality of the cast parts.

It is also possible to use the "in mould" procedure which involves providing at the entrance of the casting mould a recess in which the treatment agent will be disposed in such a way that it is regularly dissolved by the cast iron in a molten condition as it passes into the mould. That procedure is effective but it is also long and difficult to carry into effect, and in particular the configuration of the geometry of the cast iron feed passages has to be carefully designed in order to avoid the possible entrainment of endogenous or exogenous inclusions within the cast part.

That procedure is preferably reserved for long runs which make it possible to amortize the cost of development of the mould.

The document FR 2 588 571 also discloses an apparatus in which the treatment agent is introduced by means of a gas under low pressure into a closed treatment chamber which is also under low pressure and in which liquid metal to be treated and cast is disposed. Such a pressurised arrangement permits good dissolution of the agents, in particular Mg, and the production of cast parts of high quality, but it raises problems in terms of operation (fouling, blockage of the vents or risers, untimely accumulation of undissolved agent etc . . . ) when there is a wish to carry out discontinuous casting operations in series.

A similar apparatus is known from the documents EP 30 220 or BE 639 410. The treatment agent is added by means of a carrier gas to the surface of the liquid cast iron which is set in motion in the form of a vortex within a chamber. In EP 30 220 it is preferable for said chamber to be closed by a sealing cover in order to improve the efficiency of use of the agent when it is volatile (for example if it contains magnesium). This apparatus which is used for discontinuous casting operations in series with a frequent interruption in the jet of metal between two casting operations suffers from the same type of disadvantages as discussed above and requires the presence of a chamber which is sealed under pressure to facilitate the introduction of the volatile agent and to improve its effectiveness and the quality of homogeneity of the casting operations.

It is known also that, to introduce a treatment agent into liquid cast iron, it is possible to use immersed lances in which the agent is propelled by a carrier gas, but that makes it necessary always to have a substantial minimum amount of liquid metal (residue) and in addition the carrier gas is a considerable source of cooling and therefore solidification of the liquid metal.

SUMMARY OF THE INVENTION

Confronted with those problems the applicants sought to provide an apparatus which is simple to use and easy to adapt in particular to discontinuous casting of small runs of parts with the late introduction of treatment agents, in particular those comprising volatile elements such as Mg and/or which are little soluble in liquid metal.

The applicants also sought to provide a process which improves the levels of efficiency of use of the treatment agent added and the degree of constancy of the quality of the cast parts produced.

The invention is an apparatus for the late introduction of particulate alloys when casting liquid metal characterised in that it comprises a jet of liquid metal of sufficient thickness, which is confined and in motion in a mixing chamber and an introduction means, which is not immersed, for the introduction in said jet of particles of alloy, imparting to said particles a speed and an energy which are sufficient for them to penetrate deeply into the interior of the liquid metal in the zone of sufficient thickness, said zone being disposed in the vicinity of a casting orifice.

The apparatus according to the invention is generally placed between a casting ladle or furnace containing the liquid metal to be treated and cast and the mould or moulds which is or are to receive said metal.

The apparatus is particularly suited to the introduction of particulate alloy which is little soluble in the liquid metal and/or which contains a volatile element, in procedures for the discontinuous casting of series of parts, that is to say involving stopping the casting of the liquid metal between each cast part. Indeed, in the case of a highly volatile additive element such as magnesium, it is highly important that the speed of the particles and their depth of penetration is sufficient for the highly volatile element to be liberated and to react only within the liquid metal in order to improve the quality of the treated metal and the efficiency of the addition.

The jet of liquid metal which circulates in the mixing chamber, preferably at a constant flow rate, must be of a sufficient thickness in line with the zone of injection of the particles so that said thickness is greater than the depth of penetration of the particles (for example by at least 30%); it must be confined in such a way that the liquid metal is not dispersed upon injection of the particles.

In fact, injection into a jet of liquid metal flowing in the open air is not appropriate as the result obtained is generally inadequate mixing and dispersion of the jet of liquid metal as soon as the attempt is made for example to increase the speed of injection of the particles by means of a carrier gas, and that finally prevents introduction of the particles into the liquid metal and filling of the mould for the part to be cast.

Once treated, the jet of liquid metal is rapidly discharged from the mixing chamber by way of a casting orifice which is disposed in the bottom, thus feeding the mould for the part to be cast.

It is advantageous for the jet of liquid metal of sufficient thickness to be formed by a vortex which is produced by means of a runner for the feed of liquid metal, under the effect of gravity, which opens tangentially at the periphery of a rotationally symmetrical mixing chamber (being cylindrical or frustoconical) which is open upwardly, and in the vicinity of the lower part of said chamber, the bottom of which is generally profiled in such a way as to facilitate the formation of the vortex. The bottom of the chamber comprises the casting orifice by way of which the treated liquid metal flows away.

The particulate alloy is introduced into the jet of liquid metal, in general by means of a lance which is necessarily not immersed in the liquid metal. The lance is fed by a carrier gas at high speed, which is preferably inert with respect to the cast metal and which carries the particulate alloy, in such a way that said alloy issues from the lance, or any other introduction means, with a speed or an energy sufficient to penetrate, by violent projection, into the interior of the liquid metal in general by a depth of at least 1 cm and preferably about 2 cm.

It is noted that the depth of penetration of the particles is still markedly greater than that of the carrier gas; that therefore avoids any unacceptable scattering or cooling of the liquid metal.

The feed for the jet of liquid metal may be from a casting ladle of large dimensions by way of a funnel provided with a calibrated outlet nozzle for regulating the flow of liquid metal or from a system for the automatic supply of casting moulds.

The mixing chamber may be provided with an overflow orifice.

It is important for the jet of particles to be suitably oriented with respect to the flow of the liquid metal, taking account of the characteristics of the flow of liquid metal: speed, geometry, physical characteristics of the liquid metal, etc.

The projection lance can be connected directly to a container for particulate alloy which is supplied by means of a carrier gas, the flow rate and the pressure of which are sufficient to impart to the alloy the energy required for penetration into the liquid metal. The speed of the grains is of the order of 10 m/sec.

However, it is preferable to use a lance equipped with its own ejection system. In that case it is possible for it to be connected on the one hand to any particulate alloy container, which does not need to be put under pressure, by way of a distributor means (for example of vibrating type or of cell type or of guillotine type), and on the other hand to a source of carrier gas under pressure.

DESCRIPTION OF THE PREFERRED EMBODIMENTS

Figure 1:
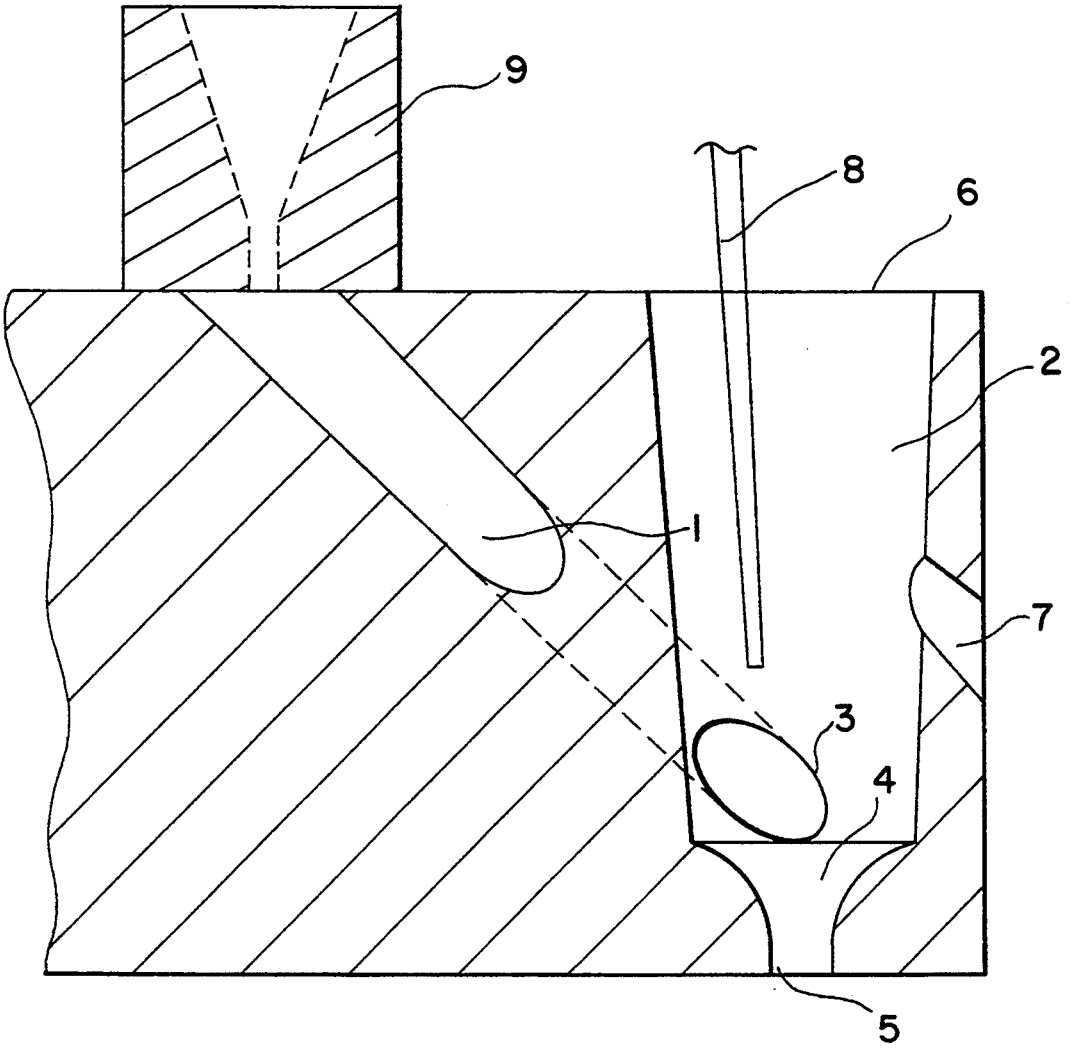
FIG. 1 is a non-limiting illustration of an apparatus according to the invention using a vortex, in vertical section; it is provided with a funnel for the feed of liquid metal.

Referring to FIG. 1, shown therein at reference 1 is the runner for the feed of liquid metal (for example cast iron) towards the mixing chamber 2. The runner opens at 3 tangentially to the periphery of the chamber and in the immediate vicinity of the vortex zone 4 which is prolonged by the casting orifice 5. The chamber here is of frustoconical shape and has a large opening 6 in its upper part and an overflow orifice 7. Reference 8 identifies the non-immersed lance 8 for the introduction at high speed of the particulate alloy into the liquid metal of the vortex. A funnel has been installed at 9 to permit the runner 1 to be supplied from a substantial casting ladle (not shown).

Figure 2:
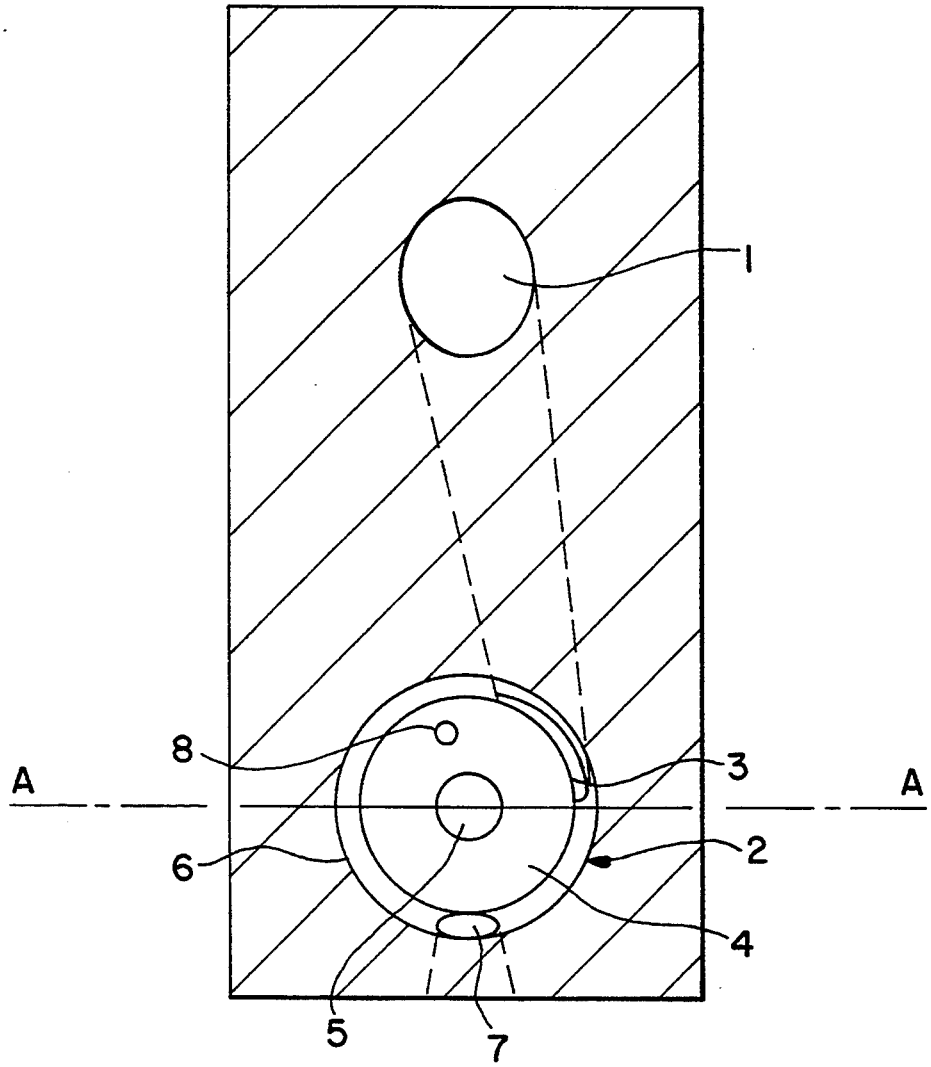
FIG. 2 is a plan view of the same apparatus but without the funnel.

Referring to FIG. 2 where the funnel is not shown, reference 1 identifies the runner which opens tangentially at 3 into the mixing chamber 2, reference 4 identifies the vortex zone, reference 5 identifies the casting orifice, reference 6 identifies the upper opening, reference 7 identifies the overflow and reference 8 identifies the location of the non-immersed lance for introduction of the particulate alloy.

Figure 3:
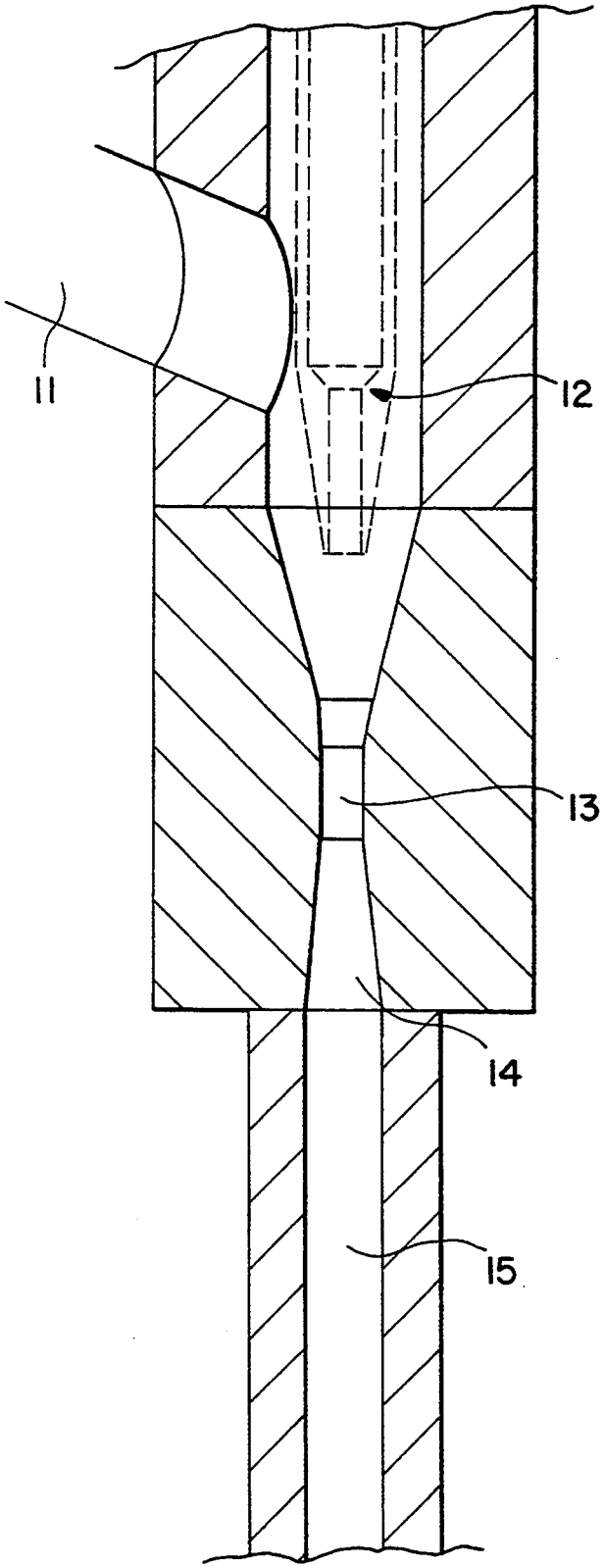
FIG. 3 shows a lance for projection by means of a carrier gas, fitted with an ejection device for imparting speed to the particles of alloy, while permitting a substantial reduction in the speed of the gas at the outlet.

Referring to FIG. 3 illustrating a lance for introducing particles, which is fitted with an ejection system imparting sufficient speed to the particles to penetrate deeply into the liquid metal, reference 11 identifies the particle supply tube which is connected to the reservoir for particles, which may be a simple container and which does not need to be a reservoir under gas pressure; that communication is preferably made by way of a particle distributing-metering means (not shown); reference 12 identifies a regulatable gas supply (generally for nitrogen) which is disposed at the level of the particle feed; reference 13 identifies at a downstream location a constriction in the jet of fluid of the venturi type, followed by a flaring enlargement 14 in the diameter of the outlet tube 15 of the non-immersed introduction lance.

The constriction 13 permits the flow of gas supplied by the tube 12 to impart the necessary energy to the solid particles while the flaring enlargement 14 associated with the short length of the outlet tube 15 makes it possible to slow down the gas while retaining the speed of the particles.

The apparatus according to the invention thus makes it possible to carry out series of discontinuous casting operations with the late introduction of additives, on all types of moulds, without fouling or the harmful accumulation of additive, being phenomena which are due to the repeated stoppages of discontinuous casting, and without the excessive danger of cooling due to the carrier gas.

It can be easily interposed between a casting ladle or an automatic feed casting apparatus and the moulds without any precaution or particular adaptation, which means that it is an apparatus that is simple to use. It can be adapted to all types of foundry operations, in particular those using automatic machines for the production of moulds in series.

This apparatus can be fitted with different regulating members (taps for the feed of liquid metal of opening type and/or involving an adjustable flow rate and/or of controlled type, means for measuring the flow rate of liquid metal, powder or gas, level detection means, timing means for the introduction of powder, etc . . . ), which permit the casting conditions to be optimised: for example casting a predetermined amount of liquid metal, introducing a corresponding metered amount of alloy at the appropriate moment and for a desired period of time.

It is possible to make improvements:

in order to avoid excessively great dispersion of the jet of liquid metal at the outlet of the casting hole of the apparatus, it is advantageous for that hole to be of a polygonal, for example square, section;

maintaining the cleanliness of the casting hole may be effected automatically, between the casting operations, by passing into the casting hole a tool of a section which is identical to that of the casting hole, being operated for example by a jack, this cleaning operation being effected at regular intervals and at a variable frequency;

to simplify its cleaning operations which are carried out from time to time, the mixing chamber may be made up of two parts which are obtained by cutting it in a vertical plane which preferably passes through the casting hole, as represented by the line AA thereof in FIG. 2; those two parts are generally assembled together by quick-fixing means.

Although it can be used for all types of liquid metal and all types of additives in powder form, it is particularly suited for the late treatment for the nodulisation and/or inoculation of casting cast irons, for example by means of alloy Fe Si Mg containing from 40% to 75% of Si and from 3 to 30% of Mg.

It also makes it possible to improve quantitatively and qualitatively the efficiency in regard to the introduction of alloys which are little soluble and/or which are volatile, such as those containing magnesium, that is to say by simultaneously improving the level of efficiency and its degree of regularity from one casting operation to another.

EXAMPLE

The results of levels of efficiency in regard to introducing magnesium, in terms of magnitude and stability, obtained with an apparatus according to the invention and in accordance with the prior art, will be compared.

Both cases involve using the same cast iron which is characterised by the following chemical analysis:

C 3.7%
Si 2.7%
S 0.008%
Fe balance and which served to cast ingots weighing 15 kg.

The treatment alloy used is of the following composition:

Mg 5.8%
Si 47%
Ca 0.54%
Aa 0.95%
Fe balance and its granulometry is between 0.2 and 2 mm.

The amount introduced is 1.1% of the weight of cast iron.

TEST 1

This test involved using a casting apparatus illustrating the prior art. A vortex is formed by means of an arrangement corresponding to that illustrated in FIGS. 1 and 2. In contrast the alloy is supplied by using a cell-type metering device at atmospheric pressure, which is connected to a distribution tube which by means of a carrier gas carries said alloy onto the vortex of liquid cast iron.

In the ingots obtained, the level of efficiency (expressed by the ratio between the amount of magnesium observed in the cast iron and the amount of magnesium introduced) is found to range between 35 and 60%; in addition, for levels of efficiency of lower than 45%, the graphite of the cast iron obtained is not totally nodular, which affects the properties of the cast iron.

The poor levels of efficiency are due to irregularities in terms of dissolution, which are manifested by fouling of the casting apparatus.

TEST 2

This Test involved using a casting apparatus according to the invention, corresponding to that illustrated in FIGS. 1 and 2, the alloy being introduced at depth into the vortex by means of a non-immersed projection lance corresponding to that shown in FIG. 3, and imparting a high speed to the grains of alloy. The lance is fed by means of the same cell-type metering device as in Test 1.

The speed of the gases at the outlet of the lance is 20 m/s and the grains penetrate to a depth of about 1 cm into the liquid cast iron of the vortex.

In the ingots obtained, the level of efficiency is found to range between 50 and 65%, with a significant improvement in terms of value and dispersion; in all cases, the result obtained is a totally nodular graphite structure.

The quality of the cast iron is suitably improved thereby.

What is claimed is:

1. Method for the late introduction of particulate alloy into liquid metal during the casting of the metal, comprising the steps of:

providing a jet of liquid metal confined and in motion in a mixing chamber having a casting orifice;

mixing a particulate alloy with a carrier gas to speed and energy to said alloy, and subsequently decelerating said carrier gas without substantially decelerating said particulate alloy;

introducing said particulate alloy into said chamber at a level above the jet of liquid metal, said particulate alloy having a speed and energy imparted thereto sufficient to penetrate said jet of liquid metal to a depth of at least 1 cm without penetration of said decelerated carrier gas to this depth; and casting said liquid metal mixed with said particulate alloy through said casting orifice.

2. Method according to claim 1, wherein vortex motion is imparted to said jet of liquid metal in said mixing chamber.

3. Method according to claim 1, wherein the particulate alloy contains magnesium.

4. Method according to claim 3, wherein the liquid metal is cast iron and the particulate alloy is based on Fe Si Mg.

5. Method according to claim 1, wherein the speed of the particulate alloy is about 10 m/s.

* * * * *